US009661980B2

(12) United States Patent
Carr et al.

(10) Patent No.: US 9,661,980 B2
(45) Date of Patent: May 30, 2017

(54) PRE-SOAK OPTION FOR DISHWASHERS

(71) Applicants: BSH Home Appliances Corporation, Irvine, CA (US); BSH Hausgeräte GmbH, Munich (DE)

(72) Inventors: Casey Carr, New Bern, NC (US); Mike Holmes, Bethel, NC (US); Melvin Rich, Kinston, NC (US)

(73) Assignees: BSH Home Appliances Corporation, Irvine, CA (US); BSK Hausgeräte GmbH, Munich (DE)

( * ) Notice: Subject to any disclaimer, the term of this patent is extended or adjusted under 35 U.S.C. 154(b) by 34 days.

(21) Appl. No.: 14/879,115

(22) Filed: Oct. 9, 2015

(65) Prior Publication Data

US 2017/0100013 A1 Apr. 13, 2017

(51) Int. Cl.
*A47L 15/44* (2006.01)
*A47L 15/00* (2006.01)
(Continued)

(52) U.S. Cl.
CPC ..... *A47L 15/44* (2013.01); *A47L 15/0007* (2013.01); *A47L 15/0028* (2013.01); *A47L 15/14* (2013.01);
(Continued)

(58) Field of Classification Search
None
See application file for complete search history.

(56) References Cited

U.S. PATENT DOCUMENTS 3,989,054 A * 11/1976 Mercer ..... A47L 15/18 134/104.1
5,427,127 A 6/1995 Nogi et al.
(Continued)

FOREIGN PATENT DOCUMENTS

BE 1018812 A3 9/2011
DE 4103563 A1 8/1991
(Continued)

OTHER PUBLICATIONS

European Search Report EP 16 19 1269 dated Nov. 18, 2016.

*Primary Examiner* — Michael Kornakov
*Assistant Examiner* — Ryan Coleman
(74) *Attorney, Agent, or Firm* — Michael E. Tschupp; Andre Pallapies

(57) ABSTRACT

A dishwasher includes an independent presoak system which may be activated by a user of the dishwasher. The dishwasher presoak system utilizes a storage tank, supply tubes, and set of nozzles which are independent from components used in a washing cycle such that a presoak detergent is applied to items placed within a washing compartment of the dishwasher without being diluted by a standard wash cycle. As part of the presoak system, the dishwasher features a detection system which allows the user to select an automatic presoak operating state whereby the dishwasher utilizes a sensor to determine if items placed into the washing compartment are sufficiently dirty to need a presoak cycle prior to a washing cycle. The dishwasher further relies on a control system to analyze samples taken of the dirtiness levels of items placed within the washing compartment and determine whether a presoak option is necessary or suggested.

13 Claims, 4 Drawing Sheets

(51) Int. Cl.
*A47L 15/14* (2006.01)
*A47L 15/42* (2006.01)

(52) U.S. Cl.
CPC ..... *A47L 15/4293* (2013.01); *A47L 15/4297* (2013.01); *A47L 2301/04* (2013.01); *A47L 2401/10* (2013.01); *A47L 2501/20* (2013.01)

(56) References Cited

U.S. PATENT DOCUMENTS

| | | | | |
|---|---|---|---|---|
| 7,523,758 | B2 * | 4/2009 | Vanderroest | A47L 15/16 134/177 |
| 8,337,631 | B2 | 12/2012 | Brown-West et al. | |
| 8,435,358 | B2 | 5/2013 | Disch et al. | |
| 2002/0062849 | A1 * | 5/2002 | Ekelhoff | A47L 15/4297 134/113 |
| 2005/0022847 | A1 | 2/2005 | Nito et al. | |
| 2010/0269863 | A1 * | 10/2010 | Disch | A47L 15/0007 134/25.2 |
| 2011/0155192 | A1 | 6/2011 | Ahmad et al. | |
| 2012/0090645 | A1 * | 4/2012 | Kessler | C11D 3/33 134/25.2 |

FOREIGN PATENT DOCUMENTS

| | | | |
|---|---|---|---|
| EP | 2868251 | A2 | 5/2015 |
| WO | 2008053348 | A2 | 5/2008 |

* cited by examiner

PRE-SOAK OPTION FOR DISHWASHERS

FIELD OF THE TECHNOLOGY

The present technology relates to a domestic dishwasher. More specifically, the present technology relates to an improved dishwasher featuring a pre-soak system which is separate from the main detergent dispensing and washing system such that the pre-soak detergent is not diluted by the normal wash cycle.

BACKGROUND

A common domestic appliance found in many homes is the dishwasher. The dishwasher generally includes a compartment within which dishes and/or crockery are placed for treatment and/or washing. The compartment usually contains at least one rack designed to hold the items placed within the compartment for cleaning. The compartment is generally enclosed and sealed by a hinged door or sliding drawer, either of which may have a handle. Within the compartment, there are usually a number of sprayers, e.g., nozzles, arranged to provide spraying water to assist with the treatment and/or washing of dishes and/or crockery. A basin designed to collect water sprayed from the nozzles is located within the base of the compartment. The basin contains a drain and a hose which allows water to drain and be removed from the compartment at the conclusion of a wash cycle. The dishwasher also includes a detergent and/or prewash dispenser arranged and configured to release detergent and/or prewash into the compartment during the wash and/or treatment cycle. The dispenser often includes a cover to hold the detergent and/or prewash in place and may be arranged to selectively release the detergent into the compartment.

The dishwasher may include one or more sumps in the bottom wall of a tub or basin comprising the dishwasher. The sumps function to collect pooled fluid which may comprise water alone or water with detergent and/or prewash materials. The mixture collected in the one or more sumps may then be pumped into and sprayed from the sprayers located in the housing of the dishwasher.

The dishwasher may comprise a control system which regulates a cycle of the dishwasher such that the cycle includes stages. Stages may include, e.g., rinsing, washing, and drying.

Available dishwashers and their cleaning cycles have limitations and shortcomings. In particular, oils, fats, vegetable matter, and other foodstuffs may become dried and crusted on crockery and dishware, especially if a user of the dishwasher fails to rinse the crockery and dishware immediately after use or the crockery and dishware is left to sit for an amount of time before running the dishwasher cycle. In such an event, the standard rinse and wash cycles found in available dishwashers may not be sufficient to clean the crockery and dishware.

Traditionally, a person facing advanced stains or difficult soiling of crockery and dishware must scrape food particles from their dishes before loading them into a dishwasher. In addition to scraping, a user may utilize a presoaking of the dishes and/or crockery, e.g., in their sink prior to loading their dishwasher. Presoaking may be required for up to 12 hours to be effective. While presoaking, the items to be washed may be placed in water or a water-soap solution. Such a solution may utilize hand soap and/or dishwashing detergent.

As part of presoaking dishware prior to being placed in a dishwasher, presoak detergents have been developed to help break down some food residues. The presoak detergents may be added to water in which soiled dishware is placed prior to being placed within a dishwasher in addition to or in lieu of hand soap and/or dishwashing detergent.

Presoak detergents differ from standard washing detergents. In particular, presoak detergents are designed for soaking and/or breaking down tough, baked-on foods from surfaces of pots and pans, amongst other items of dishware and crockery. Presoak detergents can be especially useful and effective with greasy soils, and baked-on or dried-on food residuals.

BRIEF SUMMARY

The present technology addresses one or more shortcomings of the prior art.

An aspect of the present technology includes a dishwasher with a separate system for providing a presoak treatment of at least dishware and/or crockery placed within a washing compartment of a dishwasher.

Another aspect of the present technology includes a controller configured to access and operate a presoak treatment cycle in addition to other cycles, e.g., rinsing, washing, and drying.

Another aspect of the present technology includes a control panel configured to provide a user of the dishwasher with the ability to set the controller to activate a presoak treatment cycle either manually or automatically.

Another aspect of the present technology includes a sensor which is able to detect whether a presoak treatment cycle is appropriate or needed for a particular load of dishware and crockery.

Another aspect of the present technology includes at least a first pump configured to supply the pressure needed to spray a washing detergent onto dishware and/or crockery placed within the dishwasher.

Another aspect of the present technology includes at least a second pump configured to supply the pressure needed to spray the presoak detergent onto dishware and/or crockery placed within the dishwasher.

Another aspect of the present technology includes a domestic appliance comprising: a housing; a compartment within the housing; an opening arranged in the compartment configured to allow the insertion and/or removal of items to be cleaned and/or treated into the housing; a door configured to close the opening and create a sealed compartment during use; a washing detergent storage tank; a presoak detergent storage tank; a first plurality of supply tubes; a second plurality of supply tubes; a first set of nozzles configured to spray the contents of the first plurality of supply tubes; and a second set of nozzles configured to spray the contents of the second plurality of supply tubes.

Another aspect of the present technology includes a configuration wherein the first plurality of supply tubes are fluidly connected with the first washing detergent storage tank and the second plurality of supply pipes are fluidly connected with the first presoak detergent storage tank.

DETAILED DESCRIPTION

The following description is provided in relation to several examples which may share common characteristics and features. It is to be understood that one or more features of any one example may be combinable with one or more features of the other examples. In addition, any single feature or combination of features in any of the examples may constitute additional examples.

Throughout this disclosure, terms such as first, second, third, etc., are used. However, use of such terms are not intended to be limiting or indicative of a specific order or preference, but instead are used to distinguish similarly described features from one another.

Figure 1:
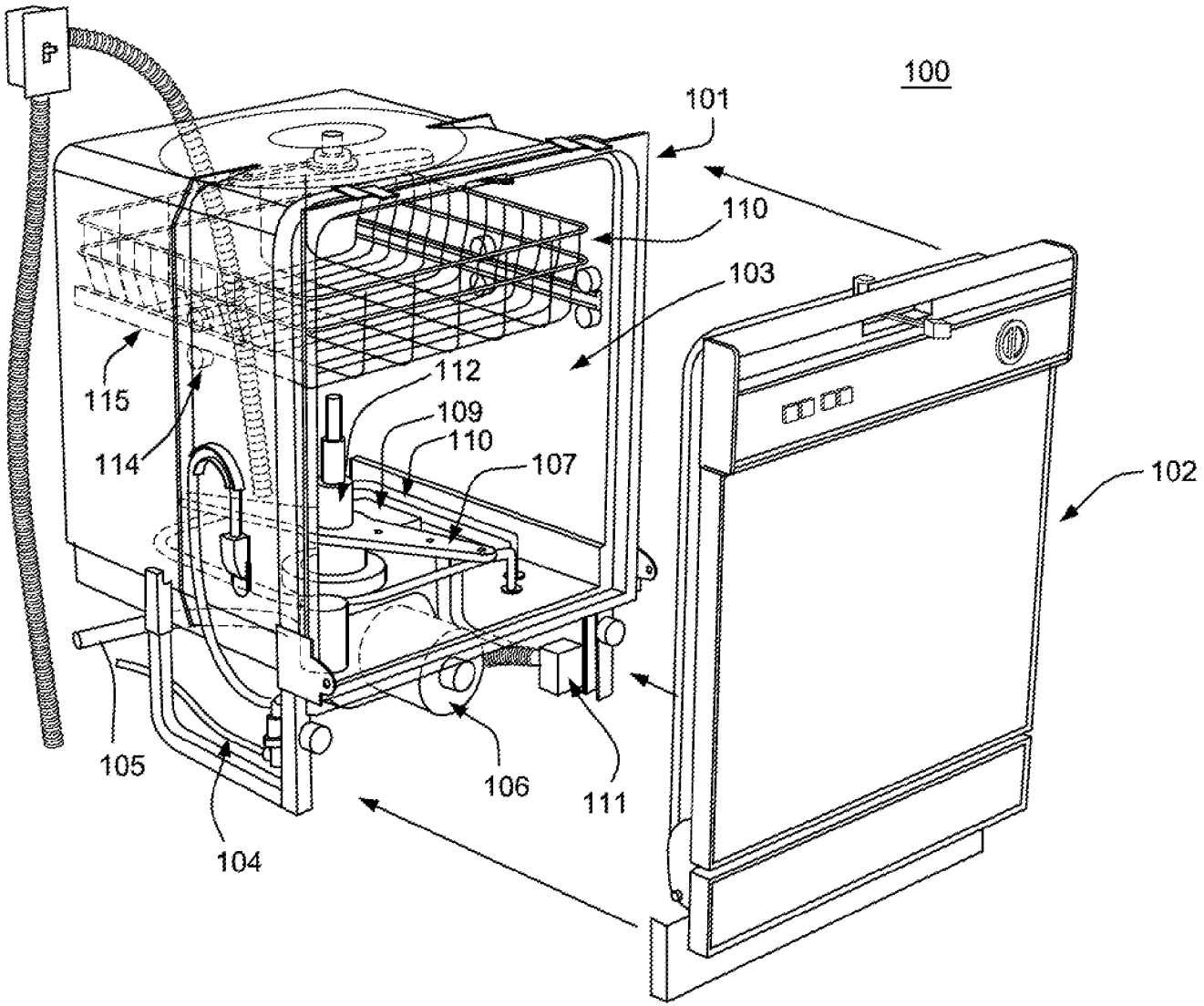
FIG. 1 (PRIOR ART)
FIG. 1 is an illustrative example of a standard dishwasher.

FIG. 1 shows an illustrative example of a standard dishwasher 100. The dishwasher as depicted is illustrated with its door 102 open to expose the dishwasher housing 101 and thus illustrates an open compartment 103 within the housing 101. The dishwasher 100 includes a water supply line 104 and a drain line 105. The dishwasher may also include at least one motor 106 which is utilized to rotate at least a first spraying element 107. Additional motors may be provided to rotate additional spraying elements which may be attached to, i.e., rack 110, the top of the compartment, and other locations determined to beneficially provide spraying to the interior of the dishwasher. Water is supplied to the dishwasher via water supply line 104 from an external source and pumped to the spraying elements via pump 109. Water may also be supplied and/or pumped to nozzles and/or spouts provided in addition to the spraying elements discussed above, such as on the walls or roof of the compartment, or via passageways which may be static or dynamic as well as fashioned within other components like a central spraying element 112, which may be configured to be extendable during a wash cycle. Water supplied to the system and/or the interior of the compartment may be heated by heating element 111. The rack may be installed within the compartment along sliding rails 115 with wheels 114 to facilitate movement into and out of the compartment. Although a door is used throughout this description, any suitable closure, such as a drawer, may also be used.

Figure 2:
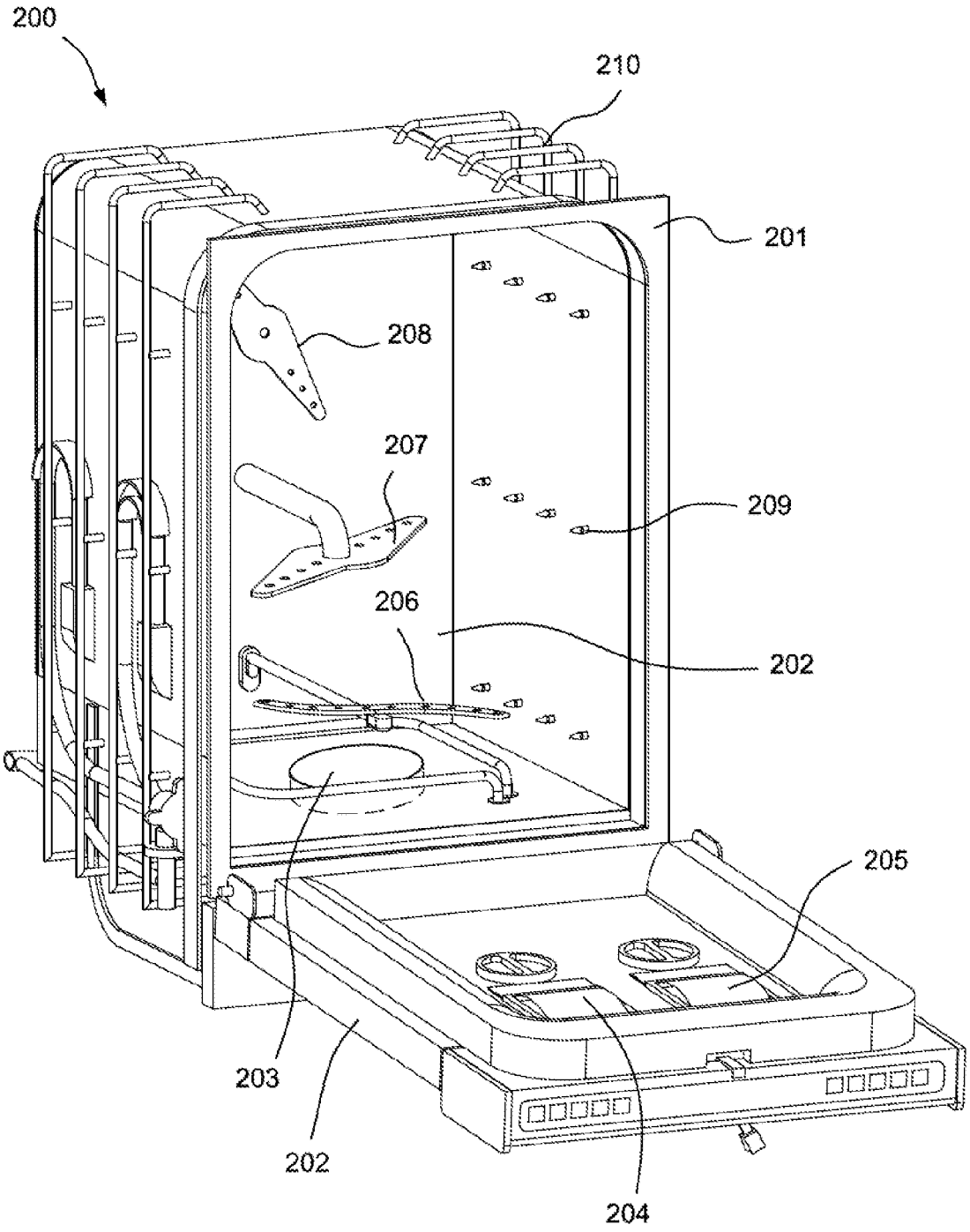
FIG. 2 is a perspective view of the improved dishwasher according to a first example of the present technology with the outer housing of the dishwasher removed.

FIG. 2 illustrates a first example of the improved design of the present technology. FIG. 2 illustrates a dishwasher 200 with its outer shell removed and frame 201 arranged inside of the dishwasher 200, with door 202 in an open or down position. Within a bottom surface of the frame 201 a hole 203 is arranged to accommodate parts of a dishwasher system which may include a drain, a motor, a pump, piping, sprayers and/or nozzles (some of which is not shown). Such a system may include a first sprayer 206, a second sprayer 207, and/or a third sprayer 208. Such sprayers may be arranged as rotating pieces with an array of spray holes or nozzles along their bodies such that water and/or wash liquor may be sprayed in the direction of any dishware and/or crockery placed within the dishwasher. The sprayers may be stationary or rotational. The sprayers may be oriented to spray upwards against gravity, downwards with gravity, laterally from a wall, surface, or other device of the dishwasher, or at an angle relative to these different directions listed herein.

As part of a novel design, the dishwasher 200 may include a variety of different sprayers 209 which are embedded within or protruding from a wall or upper or lower surface in addition to traditional sprayers. The alternative sprayers 209 may be designed and/or configured to be devoted exclusively to a presoak system. Presoak sprayers 209 may be supplied by additional pipes and/or tubes 210 which may be designed and/or configured to be devoted exclusively to a presoak system. The presoak tubes 210 are arranged in communication with and may draw presoak detergent from an independent presoak detergent tank 205, which is arranged separately from dishwasher detergent tank 204. Presoak tank 205 and tank 204 may be arranged in an interior face of the door 202 or in another suitable location. Each tank 204, 205 may be connected to a common or separate pump (not shown) to drain their respective contents and supply them to respective pipes and sprayers. The tanks 204, 205 may also be arranged without pumps such that gravity drains their contents. The common or respective pumps may be used then to pump presoak detergent and/or washing detergent with or without the inclusion of water. Water may be supplied by a water supply pipe drawing water from an external source.

Figure 3:
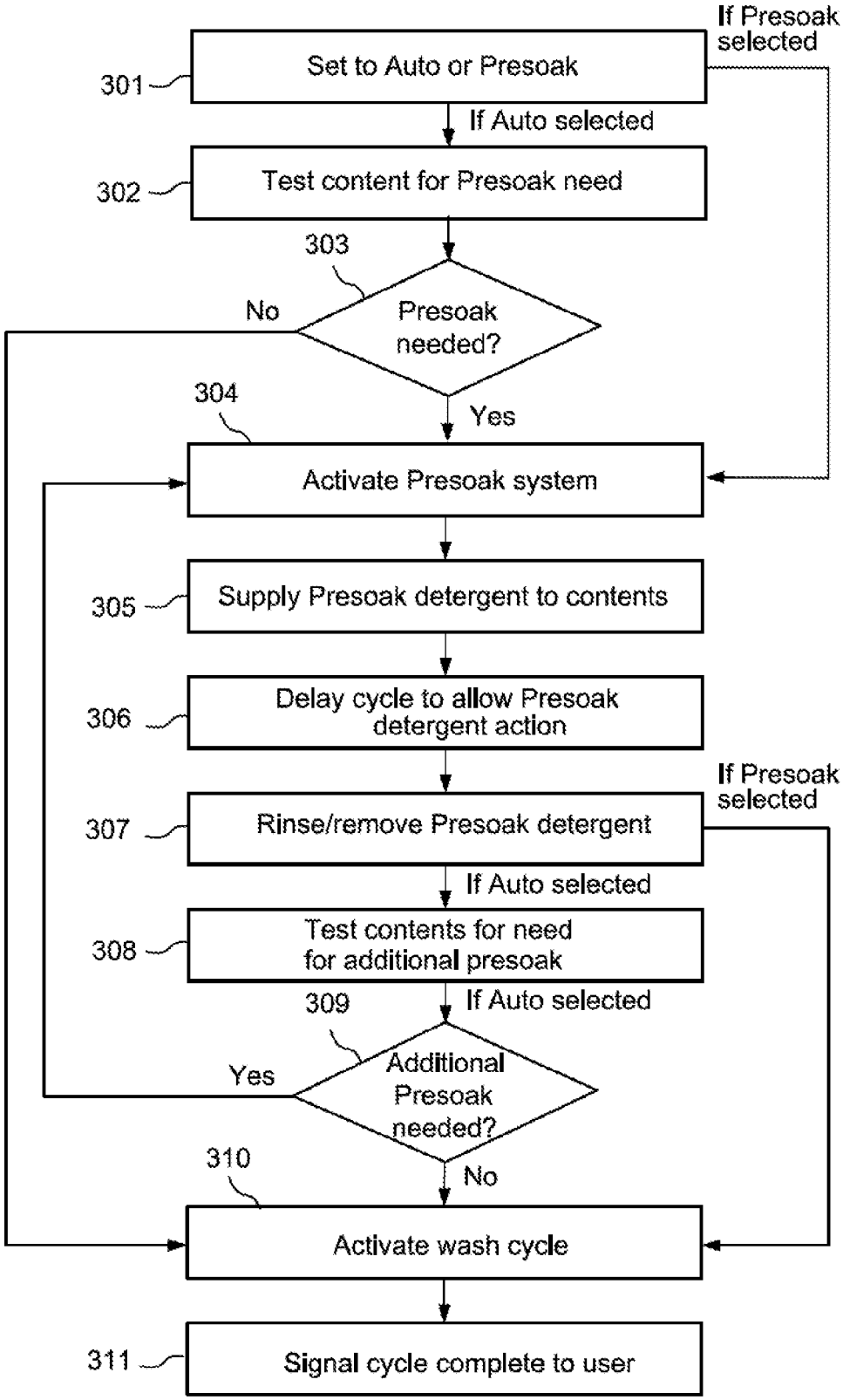
FIG. 3 is an exemplary flow chart concerning a process which may comprise the functionality of the present technology.

Effective presoak detergents differ from standard washing detergents. In particular, presoak detergents are designed for soaking and/or breaking down tough, baked-on foods from surfaces of pots and pans, amongst other items of dishware and crockery. Presoak detergents can be especially useful and effective with greasy soils, and baked-on or dried-on food residuals. As such, the incorporation of a separate system of storage, supply, and application of presoak detergents allows a dishwasher to handle a more robust variety of cleaning operations. The use of a presoak cycle permitted by such an inclusion FIG. 3 illustrates an exemplary flow chart regarding logic steps which may comprise at least part of the system disclosed herein. Step 301 requires a user of the device to select a mode prior to running the dishwasher which indicates to a controller within the dishwasher whether or not a presoak cycle should be initiated as part of the operation of the device.

A controller or processing system may include a central processing unit or CPU, a system bus that communicates with RAM and storage or a memory device. The storage can be magnetic, flash based, solid state, or other storage technology. The system bus may also communicate with a user input adapter that allows users to input commands to the processing system via a user input component (e.g., a touch input element or the like) and/or buttons. The user input component may be arranged on the door 102 or elsewhere such that a user may interact with the input component. The results of the processing may be displayed to a user on a display via a display interface (e.g., a video card or the like). The display interface may be arranged on the door 102 or elsewhere such that the user may view and/or interact with the display device. The memory device may also be included to store the functional parameters (e.g., treatment time, treatment mode, treatment temperature, etc.) input to the controller through the user input component. The controller may also operate the appliance's main wash, rinse, and other cycles.

A user may have the option of turning the presoak cycle on or off and may also have the option of setting the device to an "auto" or automatic detection function. In the auto setting, the dishwasher utilizes at least a first sensor to detect whether the dishware and/or crockery placed within the dishwasher, as indicated in step 303. Such a sensor may rely on spraying water, which may be cool, room temperature, warm, or hot, onto the items placed within the dishwasher and then measuring or observing the runoff for particulate representative of the level of dirt upon the items placed within the dishwasher. Other sensors may be utilized as well to determine the condition of the dishware and/or crockery. If the control system recognizes a need for a presoak option in step 303 using the provided sensor system, the presoak cycle is activated in step 304, whereby a presoak detergent, which is stored separately and may be different from the washing cycle detergent, e.g., in tank 205, is applied in step 305 to the interior of the dishwasher and the items stored therein. If the user selects the Presoak option directly, as opposed to the automatic detection option, step 302 may be bypassed.

Once the presoak detergent is applied to the items placed within the dishwasher, the presoak detergent is provided to and/or allowed to remain on the dishware and/or crockery for a predetermined period of time according to step 306 which may be detergent-dependent. Presoak detergents may be substantially more caustic or concentrated than standard detergent. Presoak detergents may also comprise additional components such as enzyme-based ingredients which act to break down foodstuffs and oils rather than simply to bond to them so that they will wash off dishware and/or crockery.

During the delay period in step 306, the presoak detergent acts to break down and remove dirt, oil, foodstuffs, and the like from the items within the dishwasher. During the delay period in step 306, the interior of the dishwasher may be substantially inert, meaning the presoak detergent is left to soak on and into foodstuffs, oils, and other contaminants on the dishware and/or crockery, may be intentionally filled with heat or steam, or may be configured to experience a circulation of presoak detergent and/or water being applied and/or removed from dishware and/or crockery. At the conclusion of the delay in step 306, the dishwasher acts to remove the presoak detergent from the dishware and/or crockery within the dishwasher in step 307. The dishwasher may use a standard rinse cycle or a presoak detergent-dependent rinse cycle or other method of removal.

In an automatic detection cycle selected in step 301, the sensor may once again be utilized to determine if the items within the dishwasher would benefit from an additional presoak cycle prior to a wash cycle in step 308. Step 308 may be similar to step 302 or it may be a different evaluation method. The controller then makes a decision in step 309. Similarly to step 302, the sensor tests the environment inside the dishwasher and the level of dirtiness of the dishware and/or crockery contained therein. If an additional presoak cycle would be of benefit to the items within the dishwasher, meaning that the controller evaluates the level of dirtiness of the dishware and/or crockery and decides that an additional presoak cycle would be more effective than a standard washing cycle, the controller may go back to step 304 and reactivate the presoak system. If an additional presoak cycle would not benefit the cleaning action of the dishwasher, the device controller may instead advance to step 310 and activate a wash cycle utilizing a washing detergent which may be different from the presoak detergent. If the user selected the Presoak option instead of the Automatic detection option, the appliance will only run the first presoak cycle and then move on to the wash cycle in step 310.

At the conclusion of the washing cycle, the dishwasher may indicate to a user that the cycle has been concluded in step 311. The dishwasher may also have a display which indicates the progress of the dishwasher, including a warm up, a presoak segment, a washing segment, a drying segment, and being completed.

Additionally, in another example of the present technology, the control system may be arranged to provide a recommendation to a user activating the dishwasher as to whether or not a presoak cycle is recommended. In such a configuration, the dishwasher may comprise a display on an external surface which may be arranged proximate to a control panel which allows the user to select an operating state. The dishwasher may be configured to sample the condition of items within the washing compartment for a level of dirtiness regularly at a predetermined interval using the sensor described previously or using another detection system. One example of such a sensor is the AquaSensor™ utilized to save water during wash operations by measuring the amount of soiling at the end of a pre-rinse cycle. In one example of sensor technology, light beams are used to measure the transparency of water being sprayed onto dishware and/or crockery placed within the appliance. The dishwasher may alternatively be configured to sample the level of dirtiness within the washing compartment at the time the user interacts with the control panel. In one example of the present technology, the dishwasher provides an interface with a controller which may be activated by the user to sample the washing compartment upon request. In such an example, the user can request information before choosing the operating state of the dishwasher.

Figure 4:
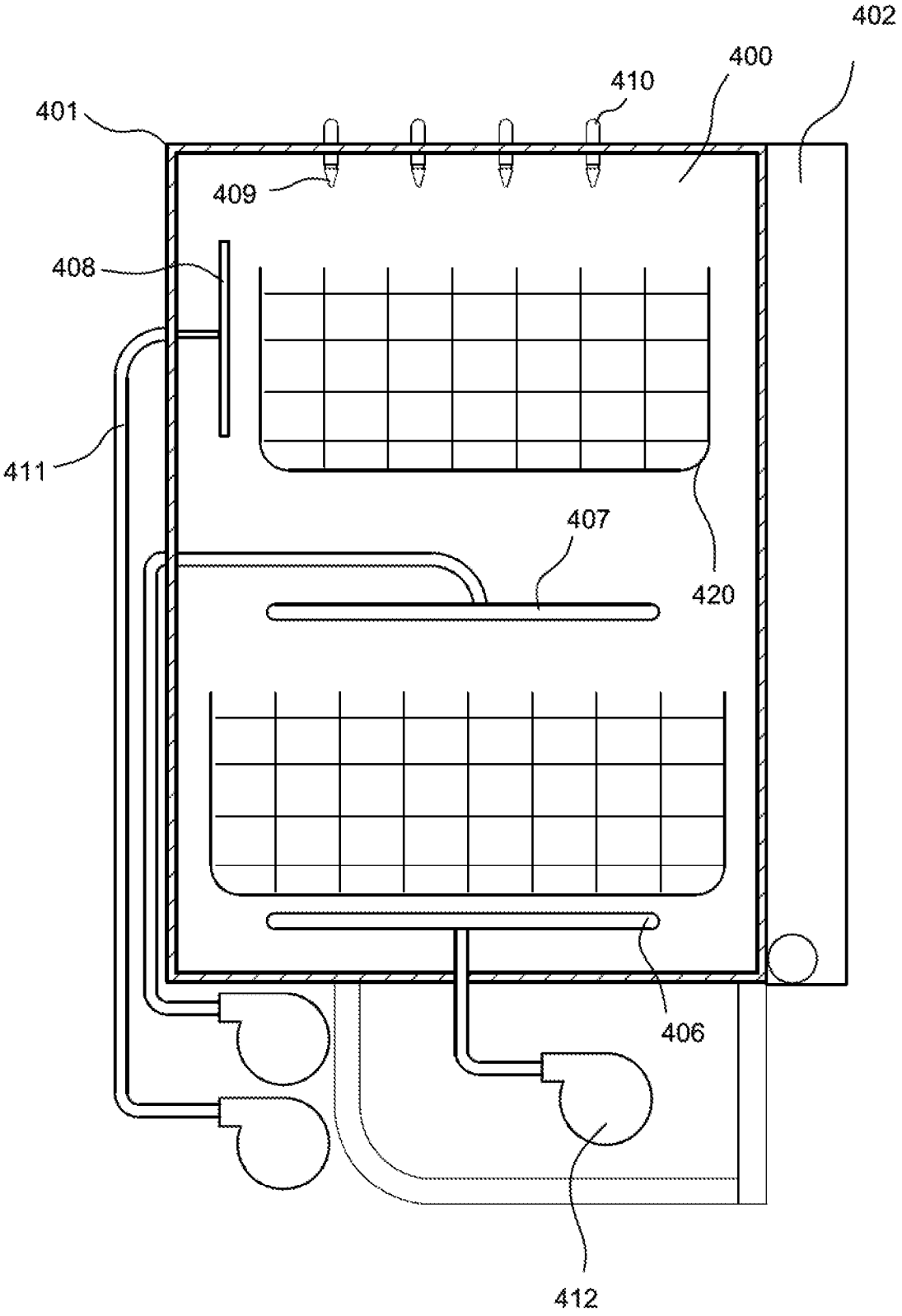
FIG. 4 is an exemplary schematic representation of the present technology.

FIG. 4 illustrates an exemplary side view of another example of the present technology. Housing 401 defines a washing compartment 400 within which racks 420 are disposed and arranged to receive dishware and crockery. First supply tubes 411 connect first supply devices 412 with a first nozzle 406, a second nozzle 407, and/or a third nozzle 408. Supply devices 412 refer collectively to, e.g., a pump, water supply line, and a detergent supply compartment (which may be similar to 204 found in FIG. 2). First supply device 412 may be separate and independent from a second supply device (which may be similar to 205 found in FIG. 2) which connects to second supply tubes 410 to supply presoak nozzles 409. As mentioned elsewhere, this is an exemplary configuration. Alternate configurations of the number of nozzles and their locations have been contemplated within the spirit of the application. For instance, the presoak nozzles may be arranged on rotating components or stationary components, on a top wall, a side wall, or a base. The presoak system may be entirely isolated from the standard washing system within the dishwasher. The presoak system may also utilize common lines to receive and deliver water and/or detergents. The presoak system may have an independent pump and/or controller or the presoak system may rely upon a common pump and/or controller used by the standard washing system.

While the present technology has been described in connection with several practical examples, it is to be understood that the technology is not to be limited to the disclosed examples, but on the contrary, is intended to cover various modifications and equivalent arrangements included within the spirit and scope of the technology.

The invention claimed is:

1. A household appliance, comprising:

a housing, the housing having a washing compartment;

a first detergent storage tank, the first detergent storage tank being configured to contain washing detergent;

at least a first supply tube;

at least a first spraying device, the first spraying device being configured to spray the contents of the at least one supply tube into the washing compartment;

a second detergent storage tank, the second detergent storage tank being configured to contain a presoak detergent;

at least a second supply tube;

wherein the first supply tube is fluidly connected with the first detergent storage tank, and wherein the second supply tube is fluidly connected with the second detergent storage tank;

at least a second spraying device comprising a plurality of stationary sprayers, wherein the second spraying device is configured to spray the contents of the second supply tube into the washing compartment, and wherein the stationary sprayers protrude from a vertical internal wall of the appliance;

a control system including a controller configured to run a presoak cycle program prior to running a washing cycle program;

wherein the controller is configured to utilize the contents of the second detergent storage tank during the presoak cycle.

2. The household appliance according to claim 1, wherein the first detergent storage tank and the second detergent storage tank are fluidly independent.

3. The appliance according to claim 1, wherein the control system is configured to determine whether to activate the presoak cycle.

4. The appliance according to claim 1, wherein the appliance further comprises a sensor configured to detect a level of dirtiness within the washing compartment.

5. The appliance according to claim 4, wherein the control system is configured to spray the washing compartment with water before any cleaning operation and the sensor is configured to determine whether the appliance should enter the presoak cycle prior to beginning the washing cycle.

6. The appliance according to claim 1, wherein the second spraying device further comprises a second plurality of stationary sprayers arranged to be protruding from an upper horizontal internal wall of the appliance.

7. The appliance according to claim 1, wherein the second supply tube comprises an array of tubes around the housing such that the plurality of stationary sprayers comprises a plurality of stationary nozzles protruding from the array of tubes associated with the second supply tube through the housing and into the washing compartment.

8. The appliance of claim 1, wherein the appliance comprises an external user control apparatus which is configured to allow a user to select a presoak cycle option as part of an operation of the appliance.

9. The appliance according to claim 1, wherein the first detergent storage tank and the second detergent storage tank are arranged side-by-side within a door configured to provide access to the washing compartment.

10. The appliance according to claim 1, wherein the second detergent storage tank is provided with a pumping system independent of the first detergent storage tank.

11. The appliance according to claim 1, wherein the plurality of stationary sprayers is arranged as a plurality of nozzles or jets configured to dispense contents originating in the second detergent storage tank as a spray.

12. The appliance according to claim 1, wherein the second spraying device is configured and arranged to spray contents originating in the second detergent storage tank into the washing compartment without intermixing with components utilized in the washing cycle.

13. The appliance according to claim 1, wherein the presoak cycle utilizes an independent water supply relative to the washing cycle.

* * * * *